US007336242B2

(12) United States Patent
Phelan et al.

(10) Patent No.: US 7,336,242 B2
(45) Date of Patent: Feb. 26, 2008

(54) ANTENNA SYSTEM INCLUDING TRANSVERSE SWING ARMS AND ASSOCIATED METHODS

(75) Inventors: Harry Richard Phelan, Palm Bay, FL (US); Russell E. Price, Palm Bay, FL (US); Kurt Zimmerman, Melbourne, FL (US)

(73) Assignee: Harris Corporation, Melbourne, FL (US)

( * ) Notice: Subject to any disclaimer, the term of this patent is extended or adjusted under 35 U.S.C. 154(b) by 94 days.

(21) Appl. No.: 11/382,944

(22) Filed: May 12, 2006

(65) Prior Publication Data

US 2008/0001845 A1 Jan. 3, 2008

(51) Int. Cl.
*H01Q 3/02* (2006.01)
*H01Q 3/10* (2006.01)

(52) U.S. Cl. ..... 343/882; 343/757; 343/766

(58) Field of Classification Search ..... 343/882, 343/765, 766, 763, 757
See application file for complete search history.

(56) References Cited

U.S. PATENT DOCUMENTS 3,202,015 A 8/1965 Moul, Jr. et al. ..... 74/665
3,439,550 A 4/1969 Goulding ..... 74/89.15
6,191,749 B1 2/2001 Nilsson ..... 343/765
6,266,029 B1 * 7/2001 Lee et al. ..... 343/911 L
6,329,956 B1 * 12/2001 Tateishi et al. ..... 343/753
6,356,247 B1 * 3/2002 Hirtzlin et al. ..... 343/911 L
6,611,236 B1 8/2003 Nilsson ..... 343/757
7,102,588 B1 * 9/2006 Phelan et al. ..... 343/882
7,212,169 B2 * 5/2007 Ogawa et al. ..... 343/753

* cited by examiner

*Primary Examiner*—Hoanganh Le
(74) *Attorney, Agent, or Firm*—Allen, Dyer, Doppelt, Milbrath & Gilchrist, P.A.

(57) ABSTRACT

An antenna system may include a base having an opening therein, and a plurality of swing arms each having a concave elongate shape and opposing ends pivotally connected to the base to permit a swinging motion within the opening of the base. The swing arms may be transverse to one another thereby defining an overlap area between the swing arms. The antenna system may further include a respective swing arm positioner connected between the base and each swing arm. An antenna carriage may be movable along the swing arms and which remains at the overlap area between the swing arms. A positioning controller may be connected to each swing arm positioner, and an antenna may be connected to the antenna carriage.

22 Claims, 7 Drawing Sheets

ANTENNA SYSTEM INCLUDING TRANSVERSE SWING ARMS AND ASSOCIATED METHODS

FIELD OF THE INVENTION

The invention relates to the field of antenna systems, and, more particularly, to antenna systems and related methods.

BACKGROUND OF THE INVENTION

An antenna may have one or more beams that are desirably scanned over an area. The scanning can be accomplished by mechanical, electronic, or a combination of mechanical and electronic techniques. For example, U.S. Pat. No. 3,202,015 to Moul, Jr. et al. discloses an antenna system having two arcuate drive members transversely connected to a support base. Each drive members has a track that engages, and is advanced across a respective drive unit connected to the support base. The advancement of each track by the respective drive unit positions an antenna connected to the two drive members.

Similarly, U.S. Pat. No. 3,439,550 to Goulding discloses a gimbal mechanism having a pair of helically threaded rods of circular arcuate configuration disposed in mutually perpendicular planes and a ball nut on each rod. The ball nut is rotated by a drive unit to pivot the arcuate rod about its center of curvature thereby positioning an antenna connected to the arcuate rods.

U.S. Pat. Nos. 6,191,749 and 6,611,236 to Nilsson disclose an antenna system having four rotatably mounted arcuate members connected to a base. The first arcuate member includes a circular cog path adapted to be rotated around a first axis by a drive unit connected to the base. The second, third, and fourth arcuate members are connected to the first arcuate member and each is driven by a respective drive unit thereby permitting each arcuate member to rotate around a respective axis.

Unfortunately, the conventional antenna positioning systems may be relatively large, complex, and expensive. This results in such systems requiring a large deployment footprint, increased maintenance and reliability problems, and fewer deployments due to cost considerations.

SUMMARY OF THE INVENTION

In view of the foregoing background, it is therefore an object of the invention to provide a more straightforward antenna system that provides a smaller deployment footprint.

This and other objects, features, and advantages in accordance with the invention are provided by an antenna system that may include a base having an opening therein, and a plurality of swing arms each having a concave elongate shape and opposing ends pivotally connected to the base to permit a swinging motion within the opening of the base. The swing arms may be transverse to one another thereby defining an overlap area between the swing arms. The antenna system may further include a respective swing arm positioner connected between the base and each swing arm. An antenna carriage may be movable along the swing arms and which remains at the overlap area between the swing arms.

For example, using two hemispherical swing arms orthogonal to each other may allow a spherical movement of the antenna carriage around the inside of an imaginary bowl formed by the swing arms as if the antenna carriage where on a pendulum. With the exception of the motion at the edge of the imaginary bowl, the antenna carriage may be capable of vectored motion in any direction. As a result, the antenna system may not suffer any "keyhole" limitation at zenith when the antenna system is used in a satellite tracking application on a mobile platform. A positioning controller may be connected to each swing arm positioner, and an antenna may be connected to the antenna carriage. Accordingly, the antenna system may be relatively straightforward and robust mechanically, and have a relatively compact overall size.

Each swing arm of the antenna system may comprise a concave elongate body and mounting stubs extending outwardly from the opposing ends of the elongate body. The antenna system may further comprise a plurality of brackets carried by the base adjacent the opening in the base. The plurality of brackets may be for rotatably mounting the mounting stubs. Each swing arm positioner may comprise a motor.

The base may comprise sidewall portions connected together to enclose the swing arms. The antenna may comprise a planar antenna. The planar antenna may comprise a phased array or reflector antenna. The plurality of swing arms may comprise first and second swing arms.

A method of the invention is directed to mounting an antenna to a base having an opening therein. The method may include pivotally connecting opposing ends of a plurality of swing arms, each having a concave elongate shape, to the base to permit a swinging motion of each swing arm within the opening in the base. The swing arms may be transverse to one another thereby defining an overlap area between the swing arms. The method may further include connecting a respective swing arm positioner between the base and each swing arm, and providing an antenna carriage movable along the swing arms and which remains at the overlap area between the swing arms. The method may further comprise connecting a positioning controller to each swing arm positioner.

DETAILED DESCRIPTION OF THE PREFERRED EMBODIMENTS

Figure 1:
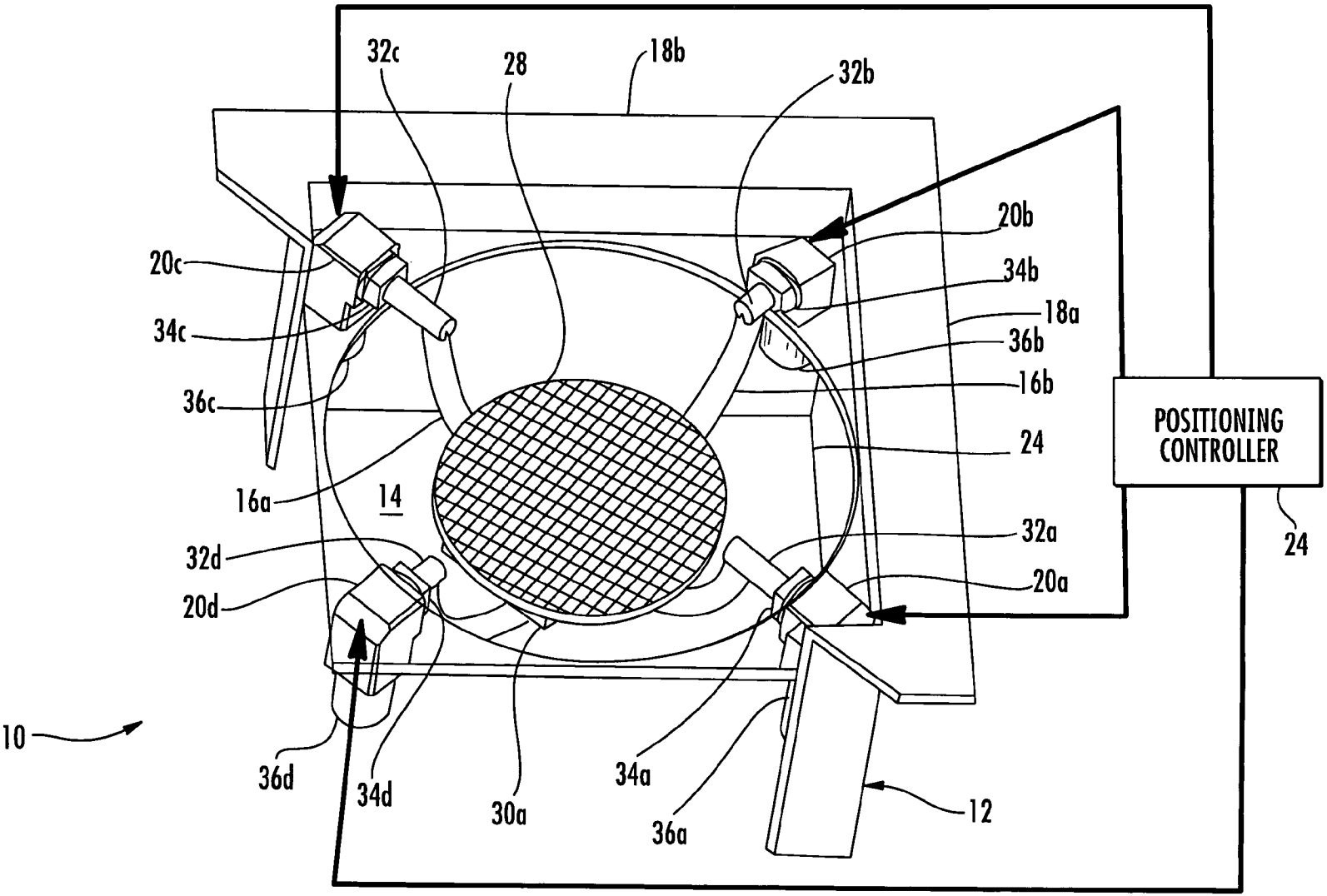
FIG. 1 is a top fragmentary perspective view of an antenna system in accordance with the invention.
Figure 2:
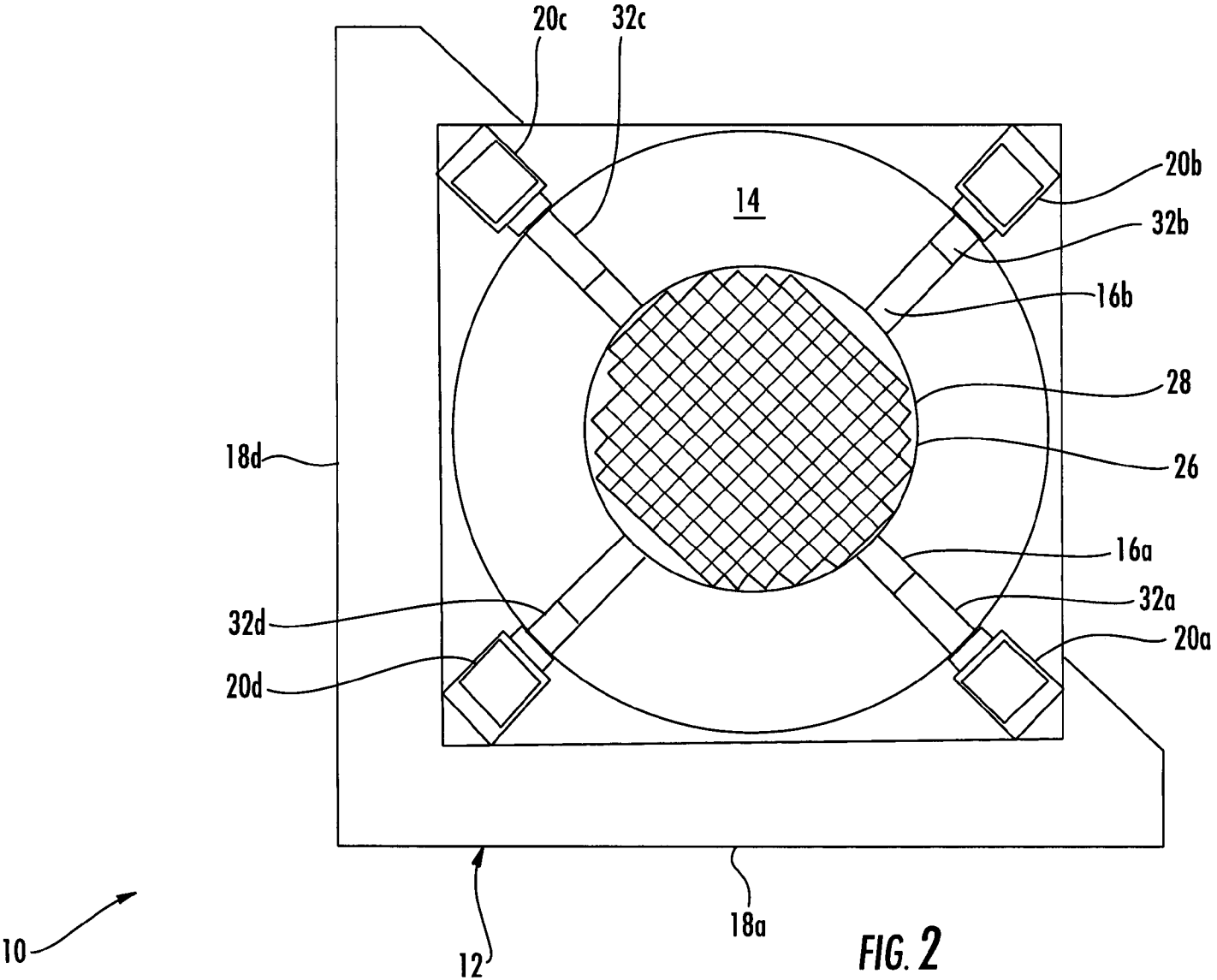
FIG. 2 is a top plan fragmentary view of the antenna system in FIG. 1.
Figure 3:
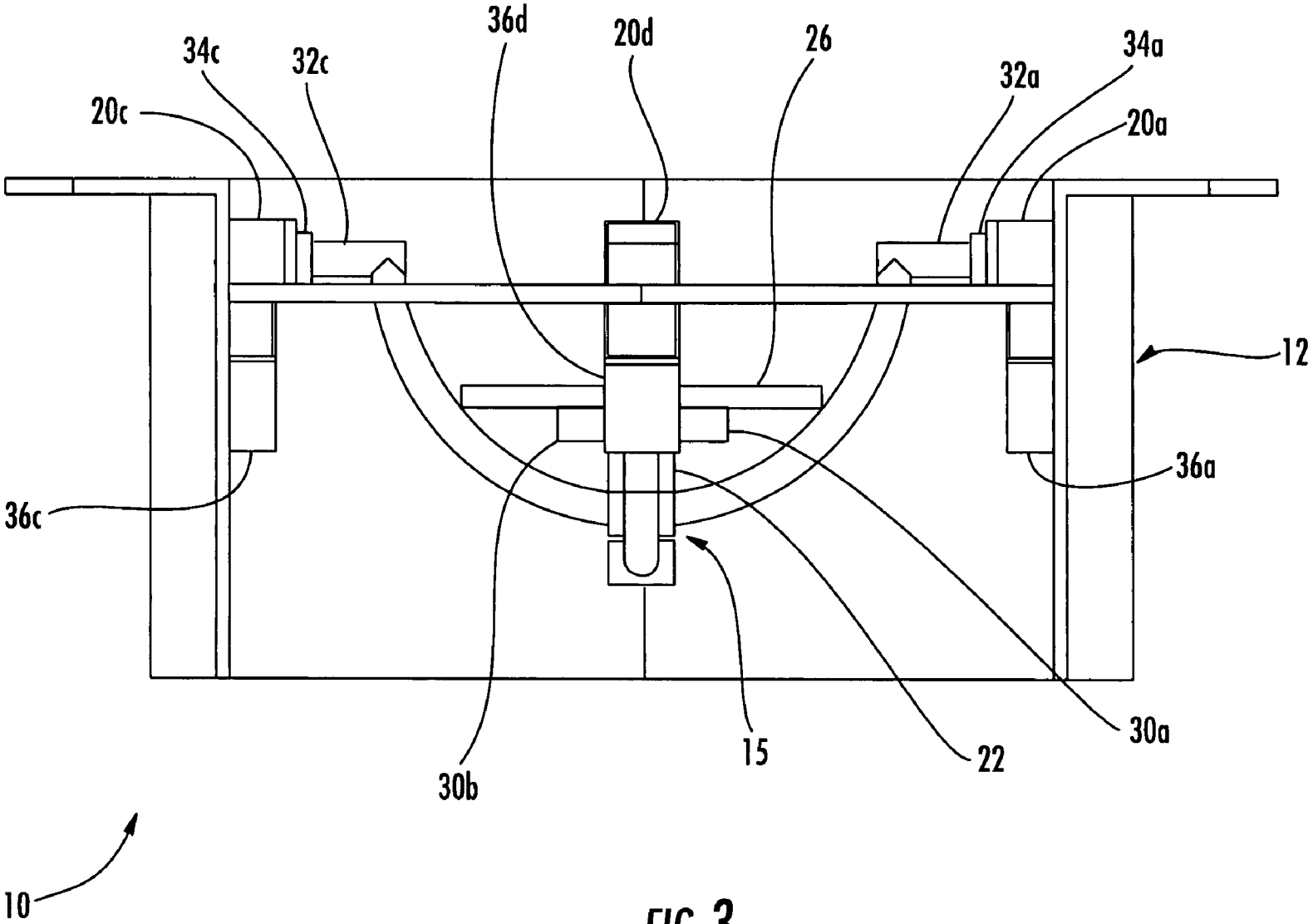
FIG. 3 is a side fragmentary perspective view of the antenna system in FIG. 1.
Figure 4:
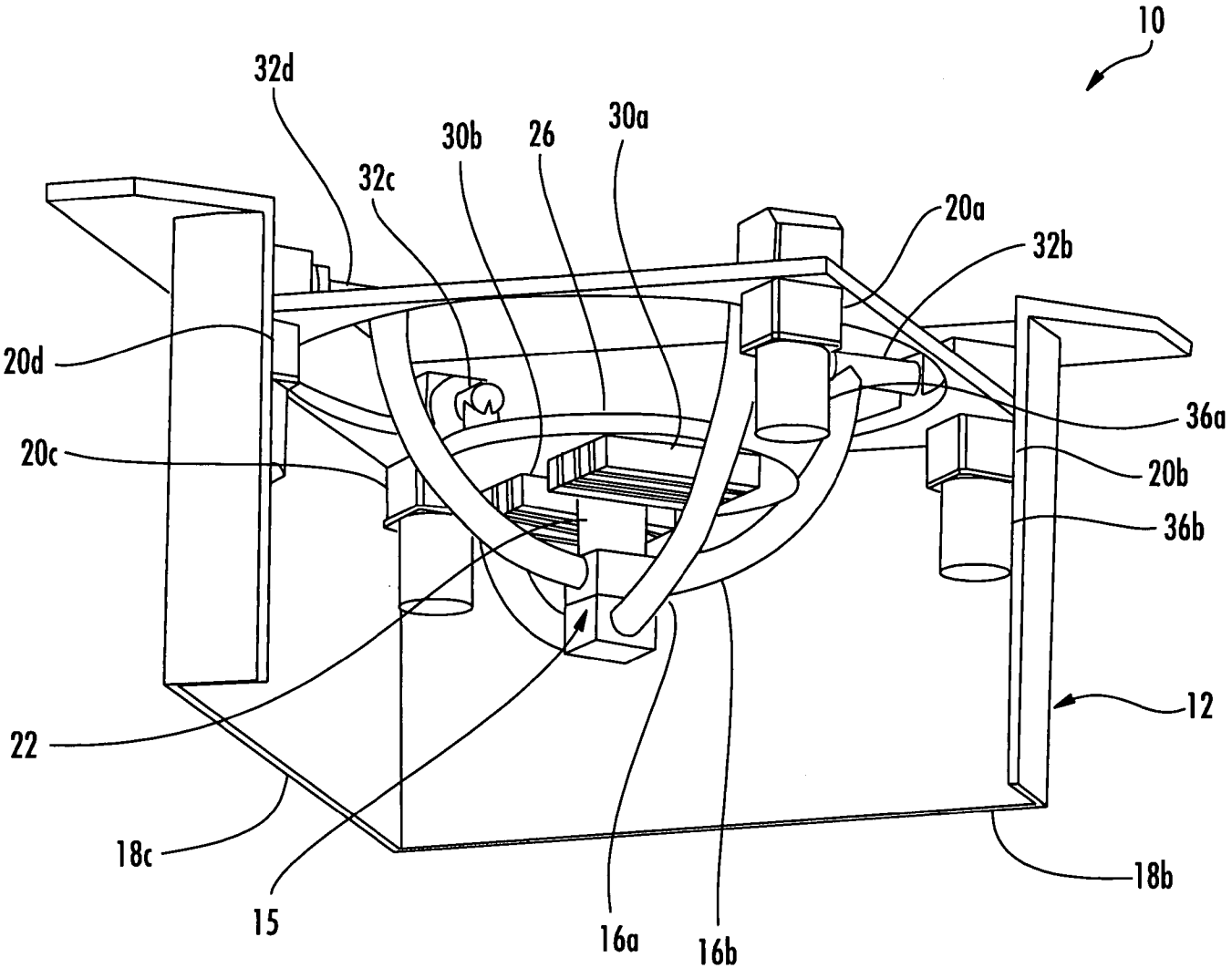
FIG. 4 is a bottom fragmentary perspective view of the antenna system in FIG. 1.
Figure 5:
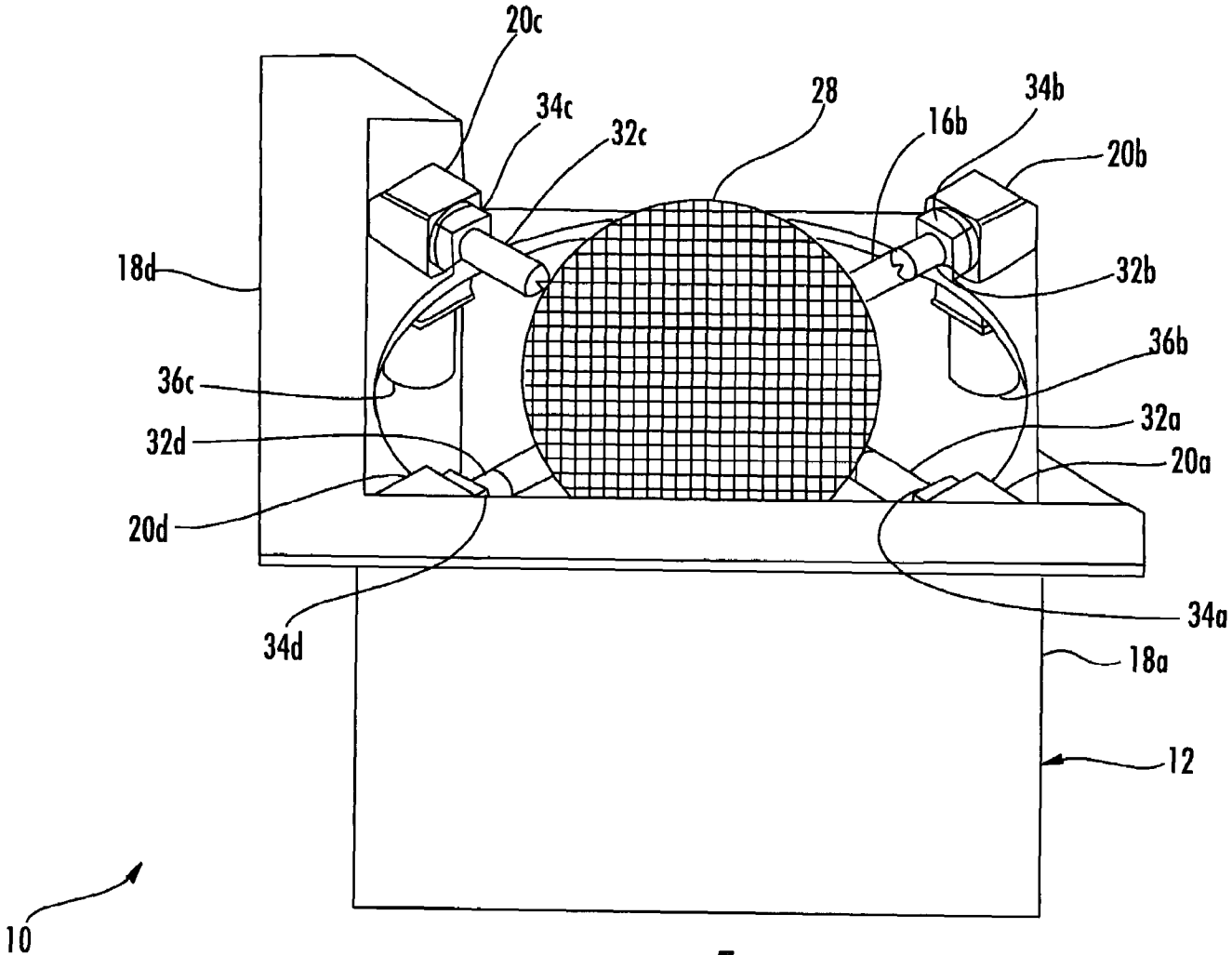
FIG. 5 is an alternate side fragmentary perspective view of the antenna system in FIG. 1.

The invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout, and prime notation is used to indicate similar elements in alternate embodiments.

Referring initially to FIGS. 1-5, an antenna system 10 in accordance with the invention is now described. The antenna system 10 includes a base 12 having an opening 14 therein. A plurality of swing arms 16*a*, 16*b*, each having a concave elongate shape and opposing ends, are pivotally connected to the base 12, for example. The pivotal connection permits a swinging motion of the plurality of swing arms 16*a*, 16*b*, within the opening 14 of the base 12 as will be appreciated by those of skill in the art. The plurality of swing arms 16*a*, 16*b* illustratively includes first and second swing arms. The base 12 illustratively includes sidewall portions 18*a*-18*d* connected together to enclose the swing arms 16*a*, 16*b*, for example.

The swing arms 16*a*, 16*b* are transverse to one another thereby defining an overlap area 15 between the swing arms. In the illustrated embodiment the swing arms 16*a*, 16*b* are perpendicular, although in other embodiments the angle may be different than 90 degrees as will be appreciated by those of skill in the art.

The antenna system 10 illustratively includes respective swing arm positioner 20*a*-20*d* connected between the base 12 and one end of the respective swing arm 16*a*, 16*b*. In an alternate embodiment, only two swing arm positioners 20*a*, and 20*b* are connected between the base 12 and one end of each respective swing arm 16*a*, 16*b*. A positioning controller 24 is connected to the swing arm positioners 20*a*, 20*b* to control how each swing arm positioner positions each respective swing arm 16*a*, 16*b* as will be appreciated by those of skill in the art.

An antenna carriage 22 is movable along the swing arms 16*a*, 16*b* and which remains at the overlap area 15 between the swing arms. For example, using two hemispherical swing arms orthogonal to each other may allow a spherical movement of the antenna carriage 22 around the inside of an imaginary bowl formed by the swing arms as if the antenna carriage where on a pendulum. With the exception of the motion at the edge of the imaginary bowl, the antenna carriage 22 may be capable of vectored motion in any direction (See FIG. 5). As a result, the antenna system 10 may not suffer any "keyhole" limitation at zenith when the antenna system is used in a satellite tracking application on a mobile platform. The antenna carriage 22 further includes an additional payload 30*a*, and 30*b* such as high power amplifiers (HPA's) and the like as will be appreciated by those of skill in the art.

Each swing arm 16*a*, 16*b* of the antenna system 10 may comprise a concave elongate body and mounting stubs 32*a*-32*d* extending outwardly from the opposing ends of the elongate body. The antenna system 10 may further comprise a plurality of brackets 34*a*-34*d* carried by the base 12 adjacent the opening 14 in the base. The plurality of brackets 34*a*-34*d* are for rotatably mounting the mounting stubs 32*a*-32*d* as will be appreciated by those of skill in the art. Each swing arm positioner 20*a*, 20*b* may comprise a motor 36*a*-36*d*, which is connected to a respective mounting stub, for example.

The antenna 26 is connected to the antenna carriage 22. The antenna 26 illustratively comprises a planar antenna, in the form of a phased array antenna 28. Other types of planar antennas may also be used.

Figure 6:
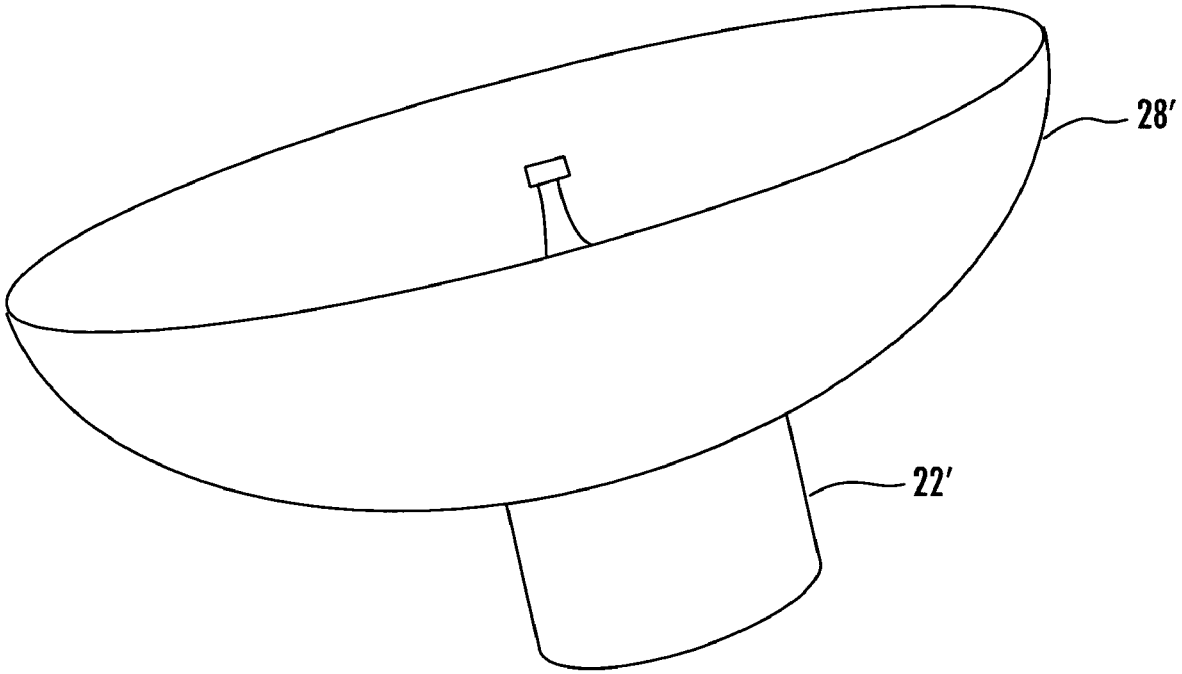
FIG. 6 is a side perspective view of another antenna configuration mounted on the antenna carriage.

Referring now additionally to FIG. 6, the antenna may also be in the form of a reflector antenna 28' mounted on the antenna carriage 22'. In this embodiment, a payload is not included.

Figure 7:
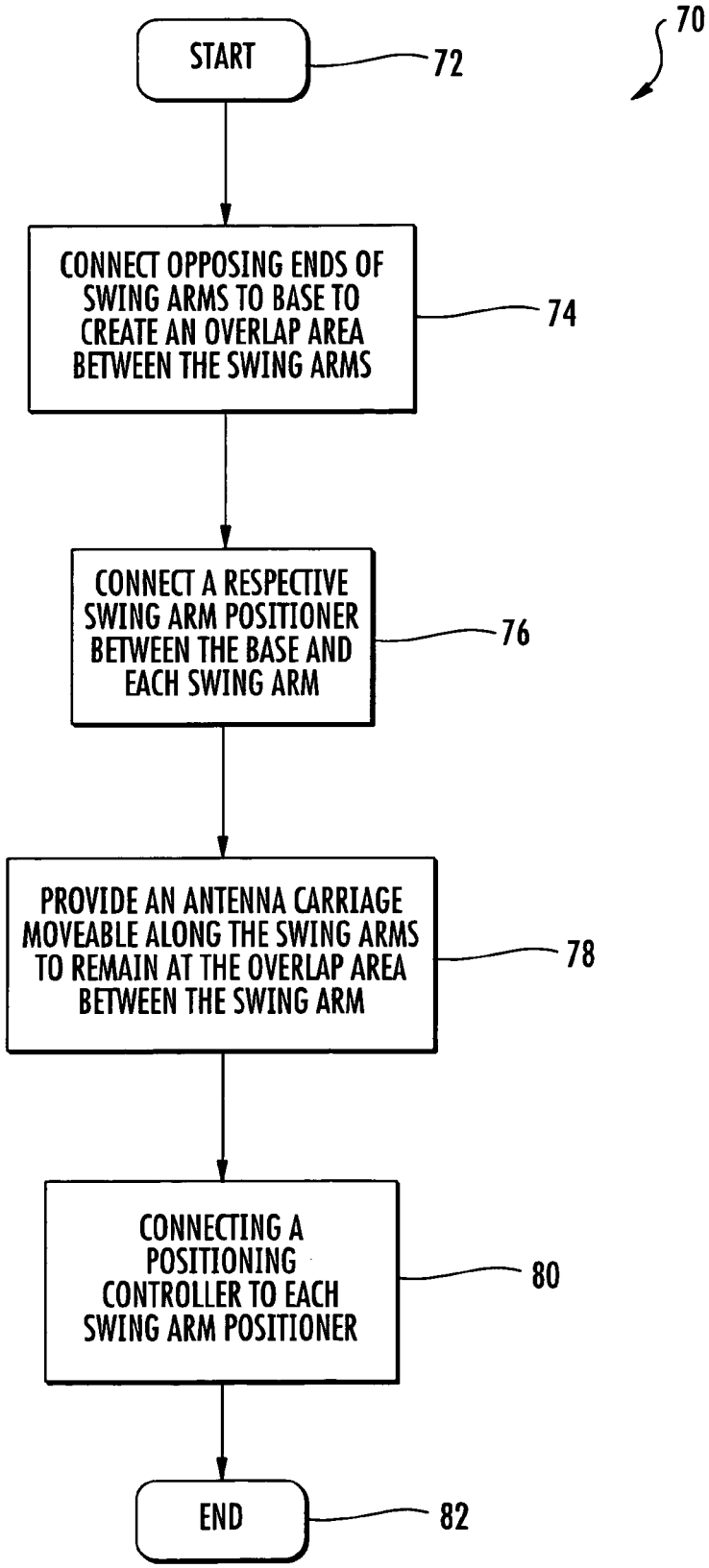
FIG. 7 is a flowchart illustrating a method according to the invention.

A method aspect of the invention is for mounting an antenna 26 to a base 12 having an opening 14 therein as now explained with additional reference to the flowchart 70 of FIG. 7. The method begins at Block 72 and may include pivotally connecting opposing ends of a plurality of swing arms 16*a*, 16*b*, each having a concave elongate shape, to the base 12 to permit a swinging motion of each swing arm within the opening 14 in the base at Block 74. The swing arms 16*a*, 16*b* may be transverse to one another thereby defining an overlap area between the swing arms. The method may further include connecting a respective swing arm positioner 20*a*, 20*b* between the base 12 and each swing arm 16*a*, 16*b* at Block 76. The method may further comprise providing an antenna carriage 22 movable along the swing arms 16*a*, 16*b* to remain at the overlap area therebetween of the first and second swing arms at Block 78. The method may further include connecting a positioning controller 24 to each swing arm positioner 20*a*, 20*b* at Block 80 before stopping at Block 82.

Many modifications and other embodiments of the invention will come to the mind of one skilled in the art having the benefit of the teachings presented in the foregoing descriptions and the associated drawings. Therefore, it is understood that the invention is not to be limited to the specific embodiments disclosed, and that other modifications and embodiments are intended to be included within the scope of the appended claims.

That which is claimed is:

1. An antenna system comprising:

a base having an opening therein;

a plurality of swing arms each having a concave elongate shape and opposing ends pivotally connected to said base to permit a swinging motion within the opening of said base, said swing arms being transverse to one another thereby defining an overlap area therebetween;

a respective swing arm positioner connected between said base and each swing arm;

an antenna carriage movable along said swing arms to remain at the overlap area therebetween;

a positioning controller connected to each swing arm positioner; and an antenna connected to said antenna carriage.

2. The antenna system of claim 1 wherein each swing arm comprises a concave elongate body and mounting stubs extending outwardly from the opposing ends thereof; and further comprising a plurality of brackets carried by said base adjacent the opening therein and rotatably mounting said mounting stubs.

3. The antenna system of claim 1 wherein each swing arm positioner comprises a motor.

4. The antenna system of claim 1 wherein said base comprises sidewall portions connected together to enclose said swing arms.

5. The antenna system of claim 1 wherein said antenna comprises a planar antenna.

6. The antenna system of claim 5 wherein said planar antenna comprises a phased array antenna.

7. The antenna system of claim 1 wherein said antenna comprises a reflector antenna.

8. The antenna system of claim 1 wherein said plurality of swing arms comprises first and second swing arms.

9. An antenna positioning assembly for mounting an antenna to a base having an opening therein, the antenna positioning assembly comprising:

a plurality of swing arms each having a concave elongate shape and opposing ends to be pivotally connected to the base to permit a swinging motion within the opening of the base, said swing arms being transverse to one another thereby defining an overlap area therebetween;

a respective swing arm positioner to be connected between the base and each swing arm; and an antenna carriage for carrying the antenna and being movable along said swing arms to remain at the overlap area therebetween.

10. The antenna positioning assembly of claim 9 further comprising a positioning controller connected to each swing arm positioner.

11. The antenna positioning assembly of claim 9 wherein each swing arm comprises a concave elongate body and mounting stubs extending outwardly from the opposing ends thereof; and further comprising a plurality of brackets to be carried by the base adjacent the opening therein and rotatably mounting said mounting stubs.

12. The antenna positioning assembly of claim 9 wherein each swing arm positioner comprises a motor.

13. The antenna positioning assembly of claim 9 wherein said plurality of swing arms comprises first and second swing arms.

14. A method of mounting an antenna to a base having an opening therein, the method comprising:

pivotally connecting opposing ends of a plurality of swing arms, each having a concave elongate shape, to the base to permit a swinging motion of each swing arm within the opening in the base, the swing arms being transverse to one another thereby defining an overlap area therebetween;

connecting a respective swing arm positioner between the base and each swing arm; and providing an antenna carriage movable along the swing arms to remain at the overlap area therebetween.

15. The method of claim 14 further comprising connecting a positioning controller to each swing arm positioner.

16. The method of claim 14 wherein each swing arm comprises a concave elongate body and mounting stubs extending outwardly from the opposing ends thereof; and further comprising a plurality of brackets carried by the base adjacent the opening therein and rotatably mounting the mounting stubs.

17. The method of claim 14 wherein each swing arm positioner comprises a motor.

18. The method of claim 14 wherein the base comprises sidewall portions connected together to enclose the swing arms.

19. The method of claim 14 wherein the antenna comprises a planar antenna.

20. The method of claim 19 wherein the planar antenna comprises a phased array antenna.

21. The method of claim 14 wherein the antenna comprises a reflector antenna.

22. The method of claim 14 wherein the plurality of swing arms comprises first and second swing arms.

* * * * *